United States Patent [19]

Campau

[11] 4,420,156

[45] Dec. 13, 1983

[54] IRON-TYPE GOLF CLUBS

[75] Inventor: Daniel N. Campau, Grand Rapids, Mich.

[73] Assignee: Pepsico, Inc., Purchase, N.Y.

[21] Appl. No.: 360,460

[22] Filed: Mar. 22, 1982

[51] Int. Cl.[3] ..... A63B 53/00

[52] U.S. Cl. ..... 273/77 A; 273/169

[58] Field of Search ..... 273/77 A, 169, 167 F, 273/78, 170, 171

[56] References Cited

U.S. PATENT DOCUMENTS

| | | | |
|---|---|---|---|
| 1,854,548 | 4/1932 | Hunt | 273/78 |
| 2,447,967 | 8/1948 | Stone | 273/78 |
| 2,846,228 | 8/1958 | Reach | 273/167 F X |
| 3,655,188 | 4/1972 | Solheim | 273/77 A |
| 3,995,857 | 12/1976 | Cochran et al. | 273/77 A |
| 4,027,885 | 6/1977 | Rogers | 273/169 |
| 4,322,083 | 3/1982 | Imai | 273/77 A X |

*Primary Examiner*—George J. Marlo

[57] ABSTRACT

A set of iron-type golf clubs is designed to have gear effect so that a golf ball which is hit off-center on the club is provided with a corrective spin which will tend to bring the ball back to the intended line of flight.

Each clubhead is provided with a cavity in its rear face, and the dimensions of the cavity and the dimensions of the clubhead are selected so that the center of gravity of each clubhead of the set is spaced progressively farther behind the striking face of the clubhead as the loft angle of the clubhead decreases, the moment of inertia of each clubhead progressively decreases as the loft angle of the clubhead decreases, and the radius of gyration of all of the clubheads is relatively constant. In one specific embodiment the center of gravity for clubs 2 through 9 varied from 0.171 to 0.114 inch behind the striking face, the moment of inertia varied from 13.619 to 16.423 ounce (wt.)-in.$^2$, and the radius of gyration varied between 1.271 and 1.291 inch.

18 Claims, 18 Drawing Figures

FIG. 1A
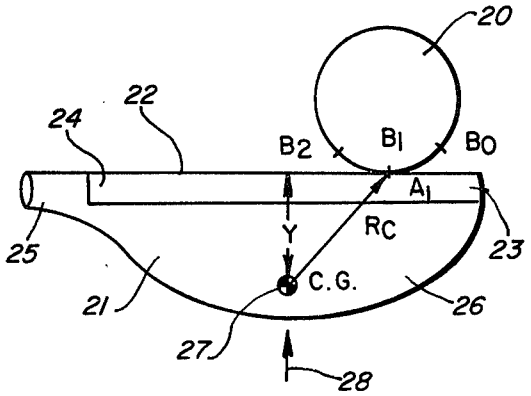
FIG. 1B
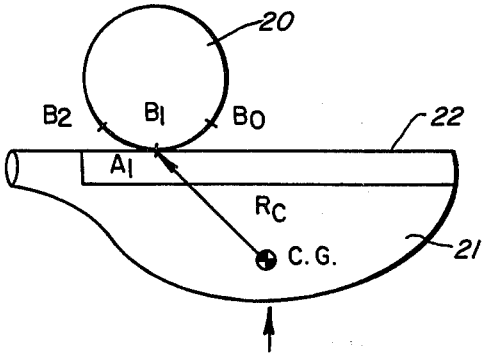
FIG. 2A
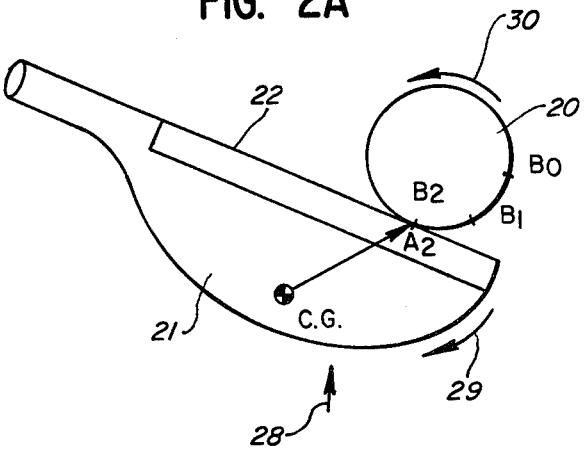
FIG. 2B
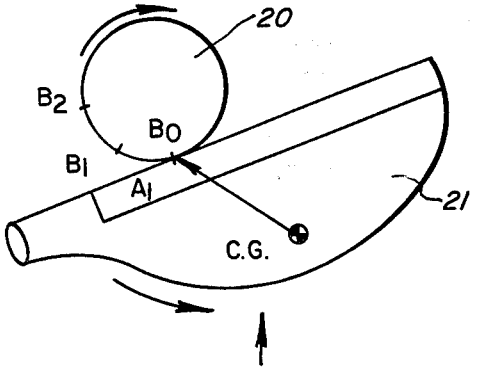
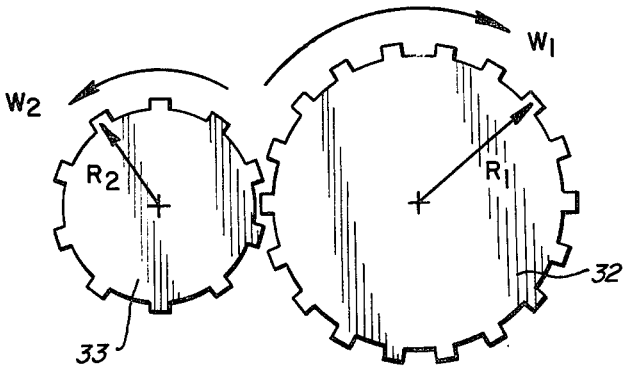
FIG. 3

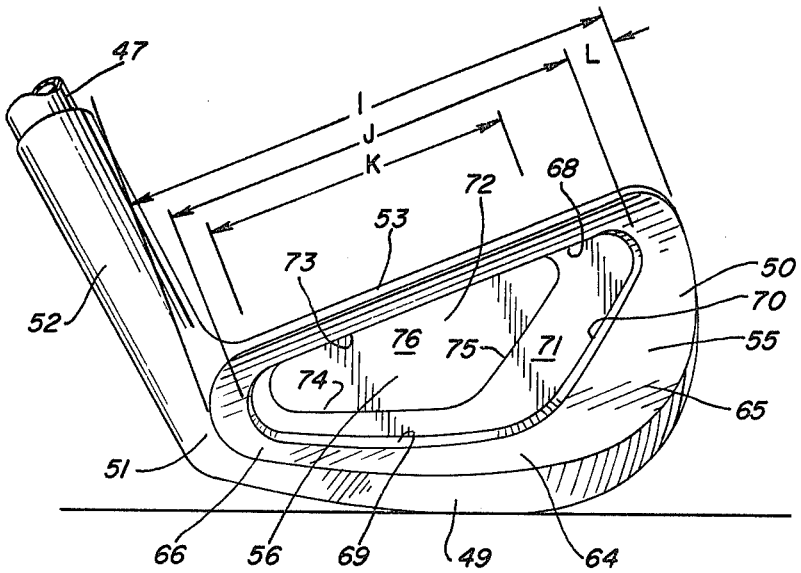
FIG. 9
FIG. 10
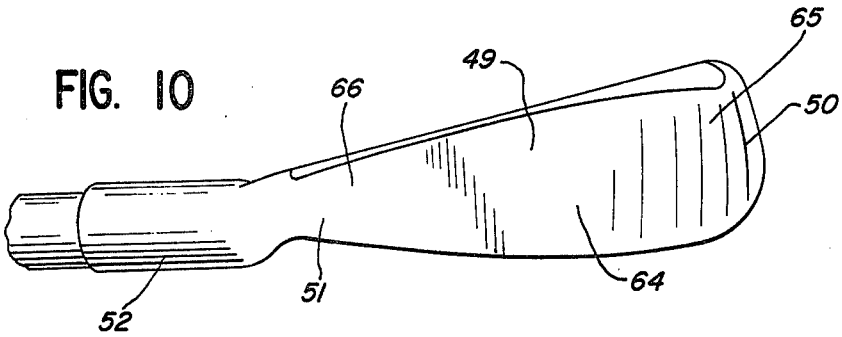
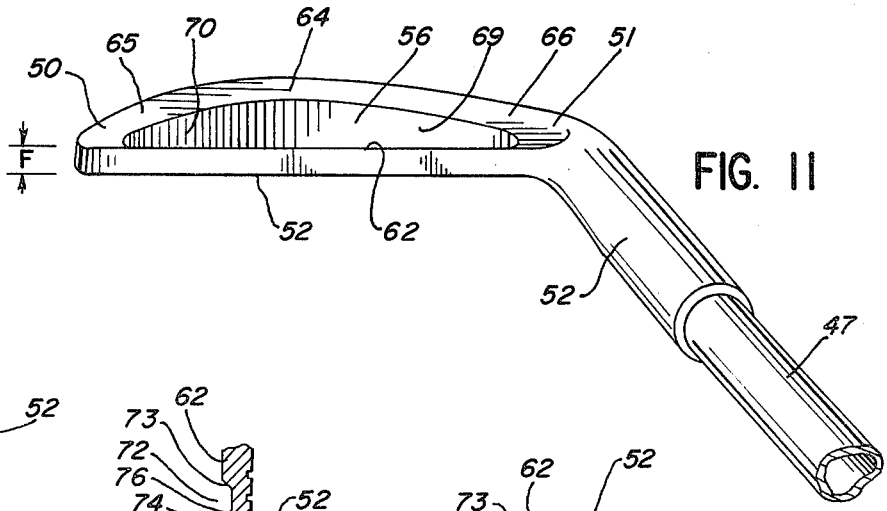
FIG. 11
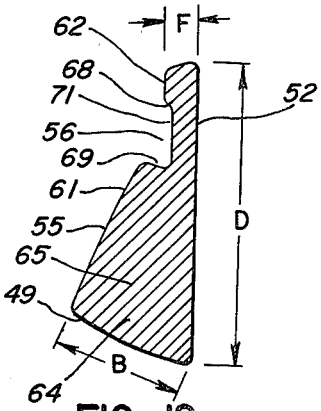
FIG. 12
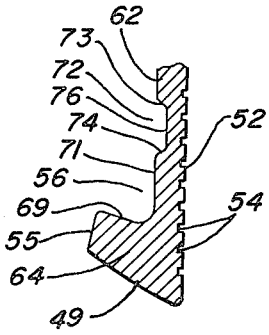
FIG. 13
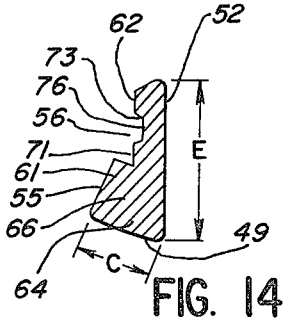
FIG. 14

IRON-TYPE GOLF CLUBS

BACKGROUND AND SUMMARY

This invention relates to golf clubs, and, more particularly, to iron golf clubs which are designed to have gear effect.

Gear effect in wooden clubs is well known. When a wooden club, e.g., a driver, strikes a golf ball at a point which is offset from the center of the face, i.e., toward the toe or heel of the club, a spin is imparted to the ball. A toe hit on a right-handed club will provide a counterclockwise or hook spin, and a heel hit on a right-handed club will provide a clockwise or slice spin.

The gear effect spin is created by a wooden club because the center of gravity of the club is spaced a substantial distance behind the striking face of the club. When the club strikes a ball on an off-center hit, the clubhead rotates about its center of gravity. The rotation of the clubhead in one direction, e.g., clockwise for a toe hit, causes the ball to rotate in the opposite direction, i.e., counterclockwise for a toe hit. An opposite rotation is imparted to the ball because the clubhead and ball rotate together much like two enmeshed gears. On a heel hit, the club rotates counterclockwise, and a clockwise or slice spin is imparted to the ball.

The clockwise rotation of a wooden clubhead on a toe hit opens the face of the club and causes the ball to fly initially to the right of the intended line of flight. However, the counterclockwise or hook spin imparted to the ball by the gear effect will cause the ball to curve back toward the intended line of flight. In most wooden clubs the gear effet spin more than compensates for the effect of the open face, and the ball would hook to the left of the intended line of flignt. For this reason the striking face of a wooden club is provided with "bulge," i.e., a curved or convex face. The bulge tends to make a toe hit fly to the right and a heel hit fly to the left. The bulge spin and the gear effect spin are advantageously adjusted so that a ball hit on either the toe or the heel lands approximately along the intended line of flight.

Most iron clubs do not impart appreciable gear effect spin to off-center hits. A ball hit on the toe of an iron will cause the clubhead to open or to rotate clockwise. However, since the center of gravity of most irons, particularly forged irons, is located very close to the striking face of the iron, very little gear effect spin will be imparted to the ball. The open face will tend to create s slice spin on the ball. Conversely, a heel hit on a conventional iron will close the face, and tend to create a hook spin.

The gear effect in wood clubs has been well known and understood for many years, and there have been suggestions to incorporate gear effect in irons. However, to the best of my knowledge no iron has been intentionally designed to impart gear effect corrective spin to a ball on off-center hits so that an off-center hit will curve back to the intended line of flight, thereby improving the accuracy of off-center hits.

I have found that optimum gear effect in irons is a function not only of the location of the center of gravity behind the striking face but also of the moment of inertia and radius of gyration of the clubhead about the center of gravity. Simply positioning the center of gravity of an iron a certain distance behind the face of the club will not necessarily produce the desired results. For example, the center of gravity of a club can be relatively far behind the face, but if the moment of inertia or radius of gyration is too low, then the club will rotate too much. The excessive rotation can cause either too much gear effect spin or too much of a tendency for the ball to fly in the direction in which the club rotates.

In accordance with the invention, the dimensions of iron clubs are selected to optimize the position of the center of gravity, the moment of inertia, and the radius of gyration so that a ball hit on the toe or the heel will tend to curve back to approximately the intended line of flight. The irons are advantageously investment cast to provide a cavity in back of the center of the striking fact so that most of the weight of the clubhead is positioned at the sole, toe, and heel portions of the club. The weight at the toe and heel increases the moment of inertia and the radius of gyration of the clubhead about the center of gravity, and the wide sole, toe, and heel cause the center of gravity to be located well behind the face. The spacing of the center of gravity behind the face of the clubs in a set progressively increases as the loft angle of the clubs decreases, the moment of inertia of the clubs in a set progressively decreases as the loft angle of the clubs decreases, but the radius of gyration of the clubs in the set is relatively constant.

DESCRIPTION OF THE DRAWING

The invention will be explained in conjunction with an illustrative embodiment shown in the accompanying drawing, in which FIG. 1A is a diagrammatic illustration of a toe hit on an iron-type golf club which is provided with gear effect;

FIG. 1B is an illustration similar to FIG. 1A showing a heel hit;

FIG. 2A is a diagrammatic illustration of gear effect spin being imparted to the golf ball by a toe hit;

FIG. 2B is an illustration of gear effect spin being imparted to a ball by a heel hit;

FIG. 3 is an illustrative view of a pair of enmeshed gears rotating in opposite directions;

FIG. 9 is a rear elevational view of the clubhead;

FIG. 10 is a bottom view taken along the line 10—10 of FIG. 8;

FIG. 11 is a top plan view taken along the line 11'11 of FIG. 7;

FIG. 12 is a sectional view taken along the line 12—12 of FIG. 7;

FIG. 13 is a sectional view taken along the line 13—13 of FIG. 7; and FIG. 14 is a sectional view taken along the line 14—14 of FIG. 7.

DESCRIPTION OF SPECIFIC EMBODIMENT

Figure 4A:
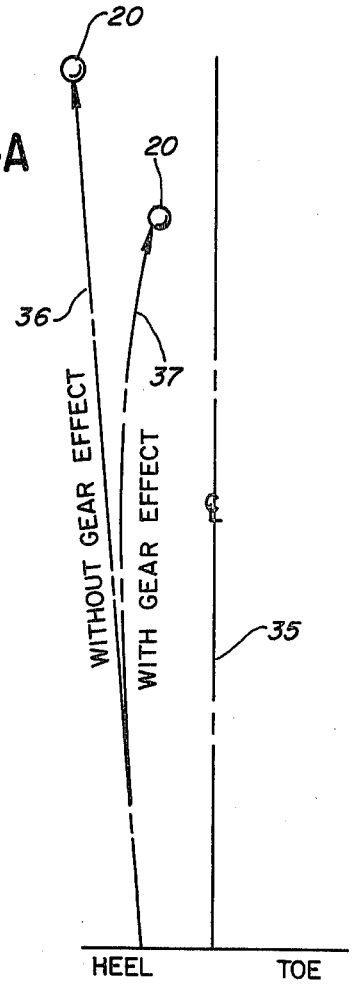
FIG. 4A is a diagrammatic illustration of heel hits on clubs with and without gear effect.

FIG. 1A illustrates a toe hit of a golf ball 20 by a clubhead 21 of an iron-type golf club which is designed to provide gear effect spin. The clubhead includes a striking face 22, a toe 23, a heel 24, and a hosel 25. A weighting portion 26 extends rearwardly behind the face, and the center of gravity 27 is located a distance y behind the face. The clubhead is swung toward the ball in the direction of the arrow 28, and the clubhead contacts the ball at a point which is toward the toe of the club.

The impact of the ball on the clubhead causes the clubhead to rotate clockwise about its center of gravity (FIG. 2A). The ball is impacted against the clubhead while the clubhead rotates, and the clockwise rotation of the clubhead in the direction of the arrow 29 causes the ball to rotate counterclockwise in the direction of the arrow 30.

The initial impact between the ball and the clubhead occurs at a point $A_1$ on the club and point $B_1$ on the ball. The impact point $A_1$ is a distance $R_c$ from the center of gravity of the clubhead. As the clubhead rotates clockwise to its FIG. 2A position, the ball will rotate counterclockwise so that the point $B_2$ on the ball contacts the point $A_2$ on the clubhead.

The counterclockwise spin imparted to the ball by the clockwise rotation of the clubhead is similar to the rotation of mating gears 32 and 33 shown in FIG. 3. Rotation of the gear 32 in a clockwise direction causes counterclockwise rotation of the gear 33.

A heel hit is illustrated in FIG. 1B. The impact between the ball 20 and the clubhead 21 occurs at point $B_1$ on the ball and point $A_1$ on the club. The heet hit causes the clubhead to rotate counterclockwise (FIG. 2B), and the ball rotates clockwise so that the point $B_0$ on the ball contacts the clubhead at $A_0$.

FIG. 4A illustrates the result of gear effect spin on a heel hit. If the club face is moving in the direction of the centerline or intended line of flight 35, a heel hit will cause the club face to close and will initially send the ball in the direction of the line 36. However, the clockwise slice spin imparted on the ball by the counterclockwise rotation of the clubhead causes the ball to slice back toward the intended line of flight as indicated by the line 37.

Figure 4B:
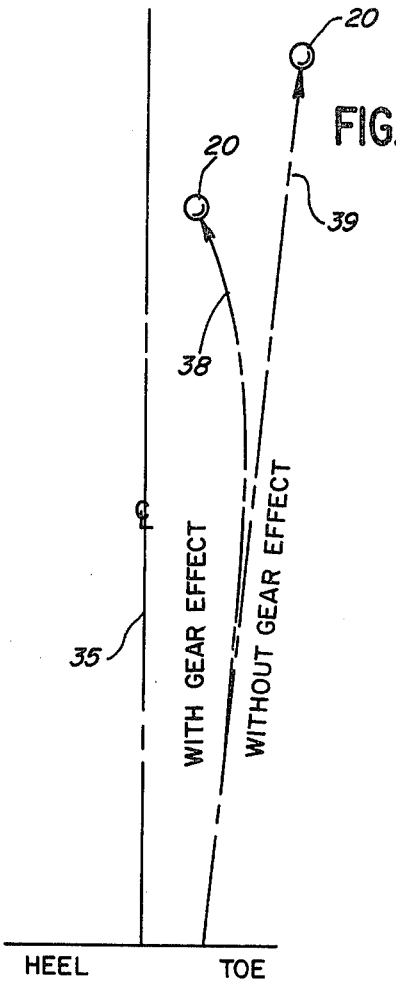
FIG. 4B is a diagrammatic illustration of toe hits on clubs with and without gear effect.

Conversely, a toe hit on a club with gear effect as illustrated in FIG. 4B will impart a counterclockwise spin to the ball and will cause the ball to curve to the left from its original direction indicated along the line 38 away from its original direction indicated by the line 39.

The gear effect is a function of the distance of the center of gravity of the clubhead behind the striking face. Returning to FIG. 3, the relationship between the angular velocity $\omega_1$ of the gear 32 which has a radius $R_1$ and the angular velocity $\omega_2$ of the gear 33 which has a radius $R_2$ is:

$$\omega_1 R_1 = \omega_2 R_2.$$

Similarly, the angular velocity of a golf ball caused by gear effect is approximated by:

$$\omega_B R_B = \omega_C R_C$$

where $\omega_B$ is the angular velocity of the ball $R_B$ is the radius of the ball $\omega_C$ is the angular velocity of the clubhead $R_C$ is the distance from the impact point to the center of gravity of the clubhead.

From the foregoing equation:

$$\omega_B = \omega_C R_{C\,i}/R_B$$

If the radius of the ball is constant, for a given clubhead rotation, the rotation of the ball varies directly with the distance of the center of gravity of the clubhead from the impact point. The greater this distance, the greater the rotational velocity or spin rate which is imparted to the ball.

Figure 5A:
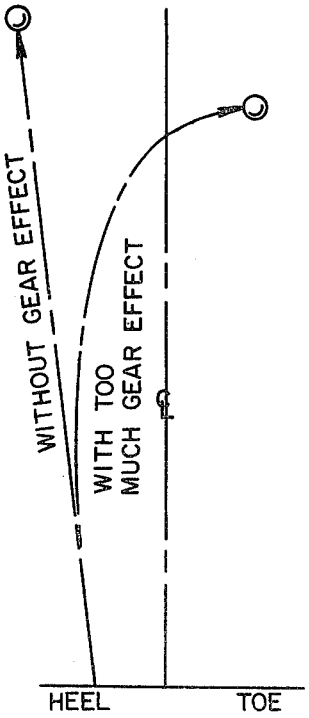
FIG. 5A is an illustration of heel hits on clubs without gear effect and with too much gear effect.
Figure 5B:
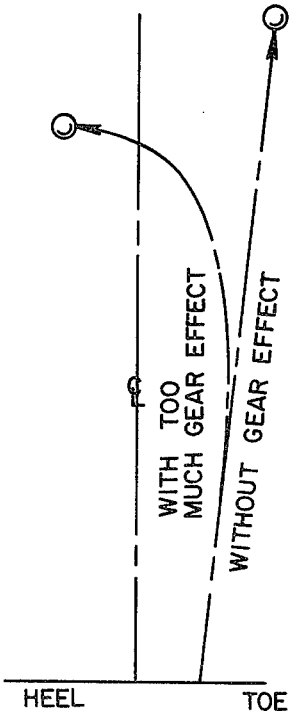
FIG. 5B is an illustration of toe hits on clubs without gear effect and with too much gear effect.
Figure 6:
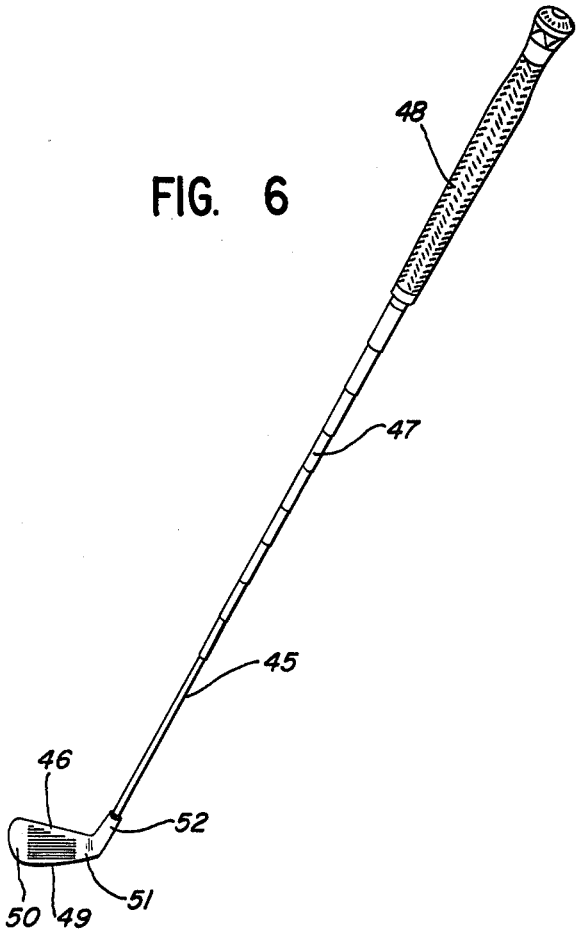
FIG. 6 is a front elevational view of a golf club formed in accordance with the invention.
Figure 8:
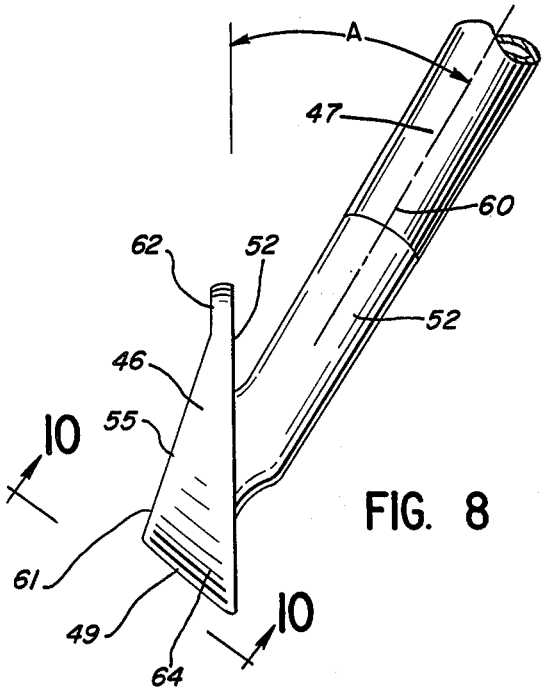
FIG. 8 is a side elevational view of the clubhead taken along the line 8—8 of FIG. 7.

It can also be seen that twoo much gear effect spin can be imparted to the ball by positioning the center of gravity too far behind the club face. This is illustrated in FIGS. 5A and 5B. FIG. 5A illustrates the flight of a ball which has excessive slice spin because of a heel hit, and FIG. 5B illustrates the flight of a ball which has excessive hook spin because of a toe hit.

However, simply positioning the center of gravity a certain distance behind the striking face will not necessarily provide the right amount of gear effect on an off-center hit. If the moment of inertia or radius of gyration with respect to the center of gravity is too low, the lubhead will rotate excessively on off-center hits.

FIGS. 6–14 illustrate a golf club in which the gear effect has been optimized. The weight of the clubhead is distributed with respect to the striking face so that the location of the center of gravity, the moment of inertia about the center of gravity, and the radius of gyration at the center of gravity are correlated to produce a highly accurate shot on an off-center hit, i.e., a shot which will curve back to substantially the intended line of flight. The appropriate center of gravity, moment of inertia, and radius of gyration for each club of a complete set is selected so that each club produces the desired results.

An iron-type golf club 45 includes a clubhead 46, a shaft 47, and a grip 48. The clubhead includes a sole portion 49, a toe portion 50, and a heel portion 51. The heel portion merges with a hosel 52 into which the shaft is inserted.

A flat striking face 52 extends upwardly from the leading edge of the sole between the toe and the heel and terminates in an inclined top edge 53. Conventional grooves 54 are provided in the striking face and extend parallel to a tangent at the center of the bottom edge of the striking face. A rear face 55 extends angularly upwardly from the trailing edge of the sole and is provided with a cavity 56 (FIGS. 9 and 12–14). The shape of the cavity and the distribution of the metal of the head is selected to produce the desired center of gravity, moment of inertia, and radius of gyration as will be explained in detail hereinafter.

The loft of the clubhead is determined by the angle A (FIG. 8) between the plane of the striking face and the centerline 60 of the shaft. The loft varies for each club in a set, e.g., from 20° for a 2 iron to 46° for a 9 iron.

The rear surface 55 includes a lower portion 61 (FIG. 8) which extends upwardly from the sole of the clubhead at an angle with respect to the striking face 52 and an upper portion 62 which is parallel to the striking face. The width of the sole between the striking face and the rear face portion 61 is substantially greater than that of most irons in order to position the center of gravity well behind the striking face. The width B (FIG. 12) of the sole at its widest point, i.e., at a section through the toe end of the grooves 54, increases as the loft of the club increases. In the preferred embodiment, the width B for a 2 iron is 0.965 inch, and the width B for a 9 iron is 1.142 inch.

The width of the sole narrows toward the heel portion (see FIG. 10). The width C of the sole at a section through the junction between the heel and the hosel (FIG. 14) varies from 0.589 inch for a 2 iron to 0.731 inch for a 9 iron.

Figure 7:
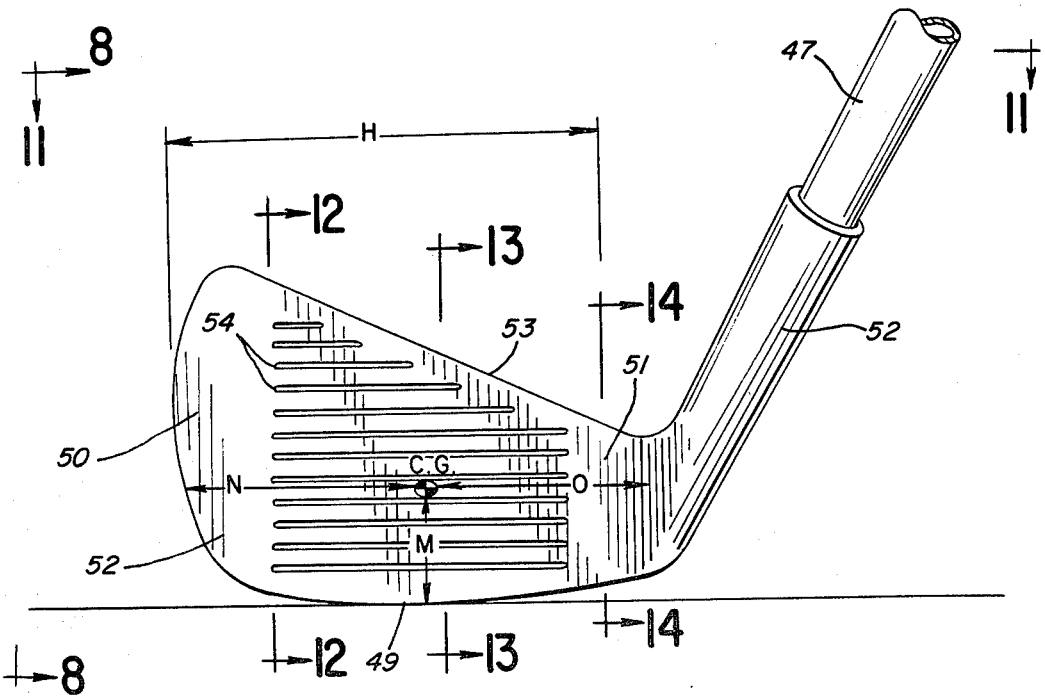
FIG. 7 is an enlarged fragmentary view of the clubhead of the club of FIG. 6.

The clubhead has a height D (FIG. 12) through the section 12—12 of FIG. 7, and a height E (FIG. 14) through the section 14—14.

In the preferred embodiment of a set of clubs containing numbers 2 through 9 pitching wedge (PW), the dimensions A through E and the weight vary as follows:

| No. | Weight (oz.) | A | B | C | D | E |
|---|---|---|---|---|---|---|
| 2 | 8.375 | 20° | 0.965 in. | 0.589 in. | 1.687 in. | 0.906 in. |
| 3 | 8.563 | 23° | 0.996 | 0.609 | 1.781 | 0.937 |
| 4 | 8.813 | 26° | 1.019 | 0.630 | 1.875 | 0.969 |
| 5 | 9.063 | 30° | 1.057 | 0.632 | 1.968 | 1.000 |
| 6 | 9.313 | 34° | 1.065 | 0.675 | 2.062 | 1.031 |
| 7 | 9.500 | 38° | 1.116 | 0.690 | 2.156 | 1.062 |
| 8 | 9.750 | 42° | 1.123 | 0.719 | 2.250 | 1.141 |
| 9 | 10.000 | 46° | 1.142 | 0.731 | 2.343 | 1.187 |
| PW | 10.250 | 50° | 1.155 | 0.777 | 2.437 | 1.234 |

The thickness F (FIGS. 11 and 12) at the top of the clubhead between the striking face 52 and the rear face 62 was constant for all clubs at 0.205 inch. Similarly, the length H (FIG. 7) of the clubhead between the toe and the section 14—14 through the junction of the hosel and the heel was constant at 2.750 inch. The toe end of the grooves 54 (section 12—12) were 0.625 inch from the toe. The length I (FIG. 9) of the clubhead in a direction parallel to the top edge 53 between the toe and the hosel was 3.312 inches for each club.

The cavity 56 in the back of the club is sized and positioned to provide a wide sole-weighting portion 64 (FIGS. 8–14), a wide toe-weighting portion 65 (FIGS. 9–12), and a heel-weighting portion 66 (FIGS. 9–11 and 14) which are wider than the corresponding portions of most clubs.

The clubhead is advantageously cast by the conventional investment casting method. A suitable corrosion-resistant stainless steel such as 17-4 PH may be used.

The cavity 56 is generally triangularly shaped (FIG. 9) and includes a straight top wall 68 which extends parallel to the top edge 53 of the club, a bottom wall 69 which extends generally parallel to a tangent at the center of the bottom edge of the striking face, a side wall 70, and a flat front wall 71 (see also FIGS. 12–14) which extends parallel to the striking face. A second or inner cavity 72 is formed in the flat front wall 71. The inner cavity includes a top wall 73 (FIGS. 9, 13, and 14) which is aligned with a portion of the top wall of the outer cavity, a bottom wall 74 which is parallel to the bottom wall 69, a side wall 75 which is parallel to the side wall 70, and a flat front wall 76 which is parallel to the striking face.

In the preferred embodiment of a set of clubs, the length J (FIG. 9) of the top wall 68 of the outer cavity between the toe and heel apexes of the cavity was 2.812 inches for all clubs, and the length K of the top wall 73 of the inner cavity between the toe and heel apexes of the inner cavity was 2.000 inches for all clubs. The distance L between the toe apex of the outer cavity and a tangent to the toe was 0.250 inch. The thickness of the club between the striking face and the flat front wall 71 of the outer cavity 56 (FIG. 12) was 0.175 inch for all clubs, and the thickness between the striking face and the flat front wall 76 of the inner cavity 72 (FIG. 13) was 0.115 inch for all clubs.

The weight of a particular member of iron is relatively constant for each manufacturer. For example, as seen from the above table, the weight of a 5 iron for the preferred embodiment is 9.063 ounces, and this is a more or less standard weight for a 5 iron. However, the size and position of the inner and outer cavities 72 and 56 in the back of clubheads formed in accordance with the invention is such that the weight is distributed to provide optimum gear effect spin to produce accurate shots even on off-center hits. This is done by optimizing the position of the center of gravity, the moment of inertia about an axis passing through the center of gravity, and the radius of gyration about the same axis.

The radius of gyration of a body with respect to an axis through the body represents the distance at which the entire mass of the body should be concentrated if its moment of inertia about that axis is to remain unchanged. The radius of gyration k and the moment of inertia I with respect to an axis through a body having a mass m are related as follows:

$$I = k^2 m \text{ or } k = \sqrt{\frac{I}{m}}.$$

The location of the center of gravity, moment of inertia with respect to an axis through the center of gravity, and the radius of gyration with respect to the axis through the center of gravity for each of the clubs in the set described in the foregoing table were determined and compared with three prior art investment cast iron clubs which had their centers of gravity spaced a significant distance behind the striking face—Ping-Eye, Sounder, and Lynx Predator. It was found that the distance between the striking face and the center of gravity of clubs formed in accordance with the invention decreased progressively from the 2 iron through the 9 iron, the moment of inertia increased progressively from the 2 iron through the 9 iron, and the radius of gyration remained high and relatively constant for all clubs. In contrast, the position of the center of gravity of the prior art clubs did not progressively decrease and seemingly varied at random, and the moments of inertia and the radii of gyration were not as high for these clubs as for corresponding clubs made in accordance with the invention.

The distance of the center of gravity behind the striking face of clubs formed in accordance with the invention, designated 1200 GE, and the prior art clubs are:

| Club No. | 1200GE | Ping-Eye | Sounder | Lynx Predator |
|---|---|---|---|---|
| 2 | 0.171 in. | 0.155 in. | 0.182 in. | * |
| 3 | 0.168 | 0.149 | 0.180 | 0.192 in. |
| 4 | 0.164 | 0.165 | 0.183 | 0.186 |
| 5 | 0.158 | 0.158 | * | 0.155 |
| 6 | 0.147 | 0.142 | 0.162 | 0.176 |
| 7 | 0.138 | 0.134 | 0.190 | 0.141 |
| 8 | 0.134 | 0.128 | 0.181 | 0.133 |
| 9 | 0.114 | 0.110 | 0.190 | 0.134 |

*This club was missing from the set when measurements were made.

The moments of inertia in ounce(wt.)-in.$^2$ of the 4 sets of clubs are:

| Club No. | 1200GE | Ping-Eye | Sounder | Lynx Predator |
|---|---|---|---|---|
| 2 | 13.619 | 12.9883 | 11.0851 | * |
| 3 | 13.845 | 13.4141 | 10.8002 | 11.3810 |
| 4 | 14.114 | 13.4958 | 10.5741 | 11.6129 |
| 5 | 14.658 | 13.7007 | * | 12.3380 |
| 6 | 14.785 | 13.8036 | * | 12.7363 |
| 7 | 15.274 | 14.4478 | 11.4689 | 14.1656 |
| 8 | 15.914 | 14.9115 | 11.7014 | 14.7948 |
| 9 | 16.423 | 16.1379 | 13.6186 | 16.2909 |

*This club was missing from the set when measurements were made.

The radii of gyration in inches of the 4 sets of clubs are:

| Club No. | 1200GE | Ping-Eye | Sounder | Lynx Predator |
|---|---|---|---|---|
| 2 | 1.288 | 1.255 | 1.210 | * |
| 3 | 1.280 | 1.259 | 1.173 | 1.163 |
| 4 | 1.279 | 1.239 | 1.150 | 1.168 |
| 5 | 1.282 | 1.235 | * | 1.187 |
| 6 | 1.271 | 1.220 | * | 1.186 |
| 7 | 1.278 | 1.225 | 1.132 | 1.234 |
| 8 | 1.288 | 1.238 | 1.129 | 1.245 |
| 9 | 1.291 | 1.271 | 1.174 | 1.287 |

*This club was missing from the set when measurements were made.

The distance of the center of gravity behind the striking face (designed "c.g."), the moment of inertia in ounce (wt.)-in.$^2$ (designated "I"), and the radius of gyration in inches (designated "k") of the 1200 GE clubs can be correlated as follows:

| Club No. | c.g. | I | k |
|---|---|---|---|
| 2 | 0.171 | 13.62 | 1.288 |
| 3 | 0.168 | 13.85 | 1.280 |
| 4 | 0.164 | 14.11 | 1.279 |
| 5 | 0.158 | 14.66 | 1.282 |
| 6 | 0.147 | 14.79 | 1.271 |
| 7 | 0.138 | 15.27 | 1.278 |
| 8 | 0.134 | 15.91 | 1.288 |
| 9 | 0.114 | 16.42 | 1.291 |

It will be seen that for the 1200 GE clubs, the position of the center of gravity progressively decreases somewhat uniformly from the 2 to the 9 iron. The moment of inertia of each 1200 GE club is higher than the moment of inertia of corresponding clubs in the other sets, and the moment of inertia progressively increases somewhat uniformly from the 2 iron to the 9 iron. The radius of gyration of each 1200 GE club is substantially higher than the radius of gyration of corresponding clubs in the other sets, and the radius of gyration of every 1200 GE club is above 1.27. The radii of gyration of the 1200 GE clubs are substantially constant throughout the set, varying between 1.271 and 1.291.

The relatively high moment of inertia and radius of gyration of each 1200 GE club reduces the tendency of the clubhead to rotate on off-center hits, and the spacing of the center of gravity behind the face provides advantageous gear effect corrective spin on off-center hits. These parameters are correlated in a unique manner to provide accurate shots even on off-center hits. The appropriate amount of gear effect spin will be imparted to the ball to bring the ball back to substantially the intended line of flight.

The position of the center of gravity of each 1200 GE club is also substantially centered with respect to the toe and heel of the club and with respect to the center of the striking face. Referring to FIG. 7, the center of gravity of each club was spaced a distance M from the bottom edge of the face, a distance N from the toe along a line which extends parallel to a tangent to the bottom edge of the club, and a distance 0 from the junction of the heel and the hosel. For a set of 2 through 9 irons these dimensions are:

| No. | M | N | O |
|---|---|---|---|
| 2 | 0.710 in. | 1.675 in. | 0.875 in. |
| 3 | 0.710 | 1.675 | 0.892 |
| 4 | 0.760 | 1.658 | 0.955 |
| 5 | 0.800 | 1.640 | 0.935 |
| 6 | 0.785 | 1.650 | 0.925 |
| 7 | 0.900 | 1.620 | 0.960 |
| 8 | 0.850 | 1.650 | 0.935 |
| 9 | 0.875 | 1.625 | 0.962 |

Manufacturing casting tolerances are such that the foregoing weights, dimensions, centers of gravity, moments of inertia, and radii of gyration for the clubs formed in accordance with the invention may vary slightly from the figures given herein. For example, the manufacturing tolerance for the weight of each clubhead is ±0.125 ounce for the 2 iron through 7 iron and ±0.188 ounce for the 9 iron and pitching wedge. The manufacturing tolerance for the dimensions is ±0.010 for two-place decimals and ±0.005 for three-place decimals. The positions of the centers of gravity can therefore vary ±0.005 in. These tolerances could cause the moments of inertia to vary about ±1% and the radii of gyration to vary about ±1%.

Sets of clubs made in accordance with the invention may include various numbers of clubs. For example, a set might includ the 2 through 9 irons, the 2 through PW irons, the 3 through 9 irons, etc. A set might also omit one or more alternate numbered clubs.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A set of at least four iron-type golf clubs, each club of the set having a shaft and a head connected to the shaft, each head having:

a sole having a leading edge and a trailing edge;

a toe, a heel, a flat striking face extending upwardly from the leading edge of the sole between the toe and the heel, the striking face extending at a different loft angle for each club of the set, a rear face extending upwardly from the trailing edge of the sole between the toe and the heel, and a cavity in the rear face, the cavity having a bottom wall which is spaced above the sole to provide a sole-weighting portion of the head between the sole and the cavity bottom wall and a side wall which is spaced from the toe to provide a toe-weighting portion of the head between the toe and the cavity side wall, the thickness, width, and weight of the sole-weighting portion and the toe-weighting portion of each head being such that:

(a) the center of gravity of each head is spaced progressively farther behind the striking face as the loft angle decreases;

(b) the moment of inertia of each head with respect to an axis of rotation of the head which passes through the center of gravity progressively decreases as the loft angle decreases; and (c) the radius of gyration of each head with respect to said axis of rotation is greater than 1.26 inch whereby each club provides gear effect spin to a golf ball which is struck by the club at a point which is on the toe side or the heel side of the center of gravity of the club.

2. The set of clubs of claim 1 in which the set includes at least eight clubs designated by the numbers 2 through 9, the loft angle of each club increasing progressively from the number 2 through the number 9 clubs, the moment of inertia of the number 2 club being greater than 13 ounce(wt.)-in.$^2$ and the moment of inertia of the number 9 club being greater than 16 ounce(et.)-in.$^2$.

3. The set of clubs of claim 2 in which the center of gravity of the number 2 club is about 0.171 inch behind the striking face and the center of gravity of the number 9 club is about 0.114 inch behind the striking face.

4. The set of clubs of claims 1, 2, or 3 in which the radius of gyration of each club is at least about 1.27 inch.

5. The set of clubs of claim 1 in which the set includes at least seven clubs designated by the numbers 3 through 9, the loft angle of each club increasing progressively from the number 3 through the number 9 club, the center of gravity of the number 3 club being about 0.168 inch behind the striking face and the center of gravity of the number 9 club being about 0.114 inch behind the striking face.

6. The set of clubs of claim 1 in which the set includes at least seven clubs designated by the numbers 3 through 9, the loft angle of each club increasing progressively from the number 3 through the numbr 9 club, the moment of inertia of the number 3 club being greater than 13 ounce(wt.)-in.$^2$, the moment of inertia of the numbers 4, 5, and 6 clubs being greater than 14 ounce(wt.)-in.$^2$, the moment of inertia of the number 7 and 8 clubs being greater than 15 ounce(wt.)-in.$^2$, and the moment of inertia of the number 9 club being greater than 16 ounce (wt.)-in.$^2$.

7. The set of clubs of claim 6 in which the center of gravity of the number 3 club is about 0.168 inch behind the striking face and the center of gravity of the number 9 club is about 0.114 inch behind the striking face.

8. The set of clubs of claims 6 or 7 in which the radius of gyration of each club is at least about 1.27 inch.

9. The set of clubs of claims 1 or 6 in which the set includes at least seven clubs designated by the numbers 3 through 9, the loft angle of each club increasing progressively from the number 3 club through the number 9 club, the maximum width of the sole adjacent the toe of each club increasing progressively from the number 3 club through the number 9 club from about 0.996 inch for the number 3 club to about 1.142 inch for the number 9 club, the width of the sole adjacent the heel of each club increasing progressively from the number 3 club through the number 9 club from about 0.609 inch for the number 3 club to about 0.731 inch for the number 9 club.

10. The set of clubs of claim 1 in which the cavity of each club is generally triangular and includes a top wall which extends generally parallel to the top of the striking face, the top wall having a length of about 2.81 inches and terminating about 0.25 inch from the toe.

11. The set of clubs of claim 1 in which the cavity of each club includes a top wall which extends generally parallel to the top of the striking face, a bottom wall which extends generally parallel to the sole, a side wall which extends angularly with respect to the toe, and a flat front wall which extends parallel to the striking face, a second, inner cavity being provided in the front wall of said first-mentioned cavity and being smaller than said first cavity, said second cavity having a top wall which is aligned with a portion of the top wall of the first cavity, a bottom wall which extends parallel to the bottom wall of the first cavity, a side wall which extends parallel to the side wall of the first cavity, and a flat front wall which extends parallel to the striking face.

12. The set of clubs of claim 11 in which the thickness of each clubhead between the striking face and the flat front wall of the inner cavity is about 0.115 inch and the thickness between the striking face and the flat front wall of the first cavity is about 0.175 inch.

13. The set of clubs of claim 11 in which the top wall of the first cavity has a length of about 2.81 inches and the top wall of the inner cavity has a length of about 2.00 inches.

14. The set of clubs of claim 11 in which the set includes at least seven clubs designated by the numbers 3 through 9, the loft angle of each club increasing progressively from the number 3 club through the number 9 club, the maximum width of the sole adjacent the toe of each club increasing progressively from the number 3 club through the number 9 club from about 0.996 inch for the number 3 club to about 1.142 inch for the number 9 club, the width of the sole adjacent the heel of each club increasing progressively from the number 3 club through the number 9 club from about 0.609 inch for the number 3 club to about 0.731 inch for the number 9 club.

15. The set of clubs of claim 14 in which the thickness of each club between the striking face and the rear face at the top of the club is about 0.205 inch.

16. The set of clubs of claim 14 in which the thickness of each clubhead between the striking face and the flat front wall of the inner cavity is about 0.115 inch and the thickness between the striking face and the flat front wall of the first cavity is about 0.175 inch.

17. The set of clubs of claims 11 or 14 in which the set includes at least seven clubs designated by the numbers 3 through 9, the loft angle of each club increasing progressively from the number 3 through the number 9 club, the center of gravity of the number 3 club being about 0.168 inch behind the striking face and the center of gravity of the number 9 club being about 0.114 inch behind the striking face.

18. The set of clubs of claims 11 or 14 in which the set includes at least seven clubs designated by the numbers 3 through 9, the loft angle of each club increasing progressively from the number 3 through the number 9 club, the moment of inertia of the number 3 club being greater than 13 ounce(wt.)-in.$^2$, the moment of inertia of the numbers 4, 5, and 6 clubs being greater than 14 ounc(wt.)-in.$^2$, the moment of inertia of the number 7 and 8 clubs being greater than 15 ounce(wt.)-in.$^2$, and the moment of inertia of the number 9 club being greater than 16 ounce(wt.)-in.$^2$.

* * * * *